US006394200B1

(12) United States Patent
Watson et al.

(10) Patent No.: US 6,394,200 B1
(45) Date of Patent: May 28, 2002

(54) DRILLOUT BI-CENTER BIT

(75) Inventors: Graham R. Watson, Houston, TX (US); Steven James Hart, Bath (GB)

(73) Assignee: Camco International (U.K.) Limited (GB)

( * ) Notice: Subject to any disclaimer, the term of this patent is extended or adjusted under 35 U.S.C. 154(b) by 0 days.

(21) Appl. No.: 09/658,857

(22) Filed: Sep. 11, 2000

Related U.S. Application Data

(60) Provisional application No. 60/163,420, filed on Nov. 3, 1999, and provisional application No. 60/162,179, filed on Oct. 28, 1999.

(51) Int. Cl.[7] ..... E21B 10/26

(52) U.S. Cl. ..... 175/385; 175/391; 175/399; 175/408

(58) Field of Search ..... 175/376, 398–400, 175/334, 385, 391, 408

(56) References Cited

U.S. PATENT DOCUMENTS

| | | | | |
|---|---|---|---|---|
| 1,587,266 | A | | 6/1926 | Zublin |
| 1,758,773 | A | | 5/1930 | Zublin |
| 2,074,951 | A | | 3/1937 | Zublin |
| 2,953,354 | A | | 9/1960 | Williams, Jr. |
| 3,237,705 | A | | 3/1966 | Williams, Jr. |
| 3,367,430 | A | | 2/1968 | Rowley |
| 3,851,719 | A | | 12/1974 | Thompson et al. |
| 4,408,669 | A | | 10/1983 | Wiredal |
| 4,440,244 | A | | 4/1984 | Wiredal |
| 4,545,441 | A | | 10/1985 | Williamson |
| 4,635,738 | A | | 1/1987 | Schillinger et al. |
| 5,040,621 | A | | 8/1991 | Löf |
| 5,050,692 | A | | 9/1991 | Beimgraben |
| 5,052,503 | A | | 10/1991 | Löf |
| 5,099,929 | A | | 3/1992 | Keith et al. |
| 5,165,494 | A | | 11/1992 | Barr |
| 5,178,222 | A | | 1/1993 | Jones et al. |
| 5,423,389 | A | | 6/1995 | Warren et al. |
| 5,497,842 | A | | 3/1996 | Pastusek et al. |
| 5,678,644 | A | | 10/1997 | Fielder |
| 5,839,525 | A | | 11/1998 | Hoffmaster et al. |
| 5,967,246 | A | | 10/1999 | Caraway et al. |
| 6,039,131 | A | | 3/2000 | Beaton ..... 175/376 |
| 6,116,356 | A | * | 9/2000 | Doster et al. ..... 175/75 |
| 6,269,893 | B1 | * | 8/2001 | Beaton et al. ..... 175/391 |
| 2001/0045305 | A1 | * | 11/2001 | Fielder ..... 175/385 |
| 2001/0045306 | A1 | * | 11/2001 | Fielder ..... 175/385 |

FOREIGN PATENT DOCUMENTS

| | | |
|---|---|---|
| EP | 0 058 061 | 8/1982 |
| EP | 0 391 873 | 10/1990 |
| EP | 0 391 874 | 10/1990 |
| EP | 0 972 908 | 1/2000 |
| EP | 1 039 095 | 9/2000 |
| GB | 2 031 481 | 4/1980 |
| GB | 2 351 513 | 8/1982 |
| GB | 2 330 599 | 4/1999 |

OTHER PUBLICATIONS

US Patent Application Publication US 2001/0020552, Beaton et al., Sep. 2001.*

* cited by examiner

*Primary Examiner*—David Bagnell
*Assistant Examiner*—Zakiya Walker
(74) *Attorney, Agent, or Firm*—Jeffery E. Daly

(57) ABSTRACT

The present invention is a bi-center drill bit designed to drill out the cement and other material in the casing and then proceed to drill out the full gauge drilling diameter borehole with a diameter greater than the inside of the casing. The bi-center drill bit is configured with non-drilling bearing elements that contact with the casing when the bit is drilling the cement without allowing the gauge cutting elements of the bi-center drill bit to contact the casing. The bi-center drill bit also has a cutting element configuration which prevents reverse scraping of the cutting elements when drilling both the cement and the formation.

72 Claims, 8 Drawing Sheets

DRILLOUT BI-CENTER BIT

This Application claims the benefit of U.S. Provisional Application No. 60/162,179 filed Oct. 28, 1999, and of U.S. Provisional Application No. 60/163,420 filed Nov. 3, 1999.

BACKGROUND OF THE INVENTION

1. Field of the Invention

This invention relates to bits used for drilling boreholes into the earth for mineral recovery. In particular, the present invention is a bi-center drill bit that can drill a borehole in the earth with a diameter greater than that of the drill bit, and also drill out the cement and float shoe after the casing has been cemented in place.

2. Description of the Related Art

In the pursuit of drilling boreholes into the earth for the recovery of minerals, there are instances when it is desirable to drill a borehole with a diameter larger than the bit itself. Drill bits used to form these boreholes are generally known as bi-center type drill bits.

Bi-center drill bits are well known in the drilling industry. Various types of bi-center drill bits are described in U.S. Pat. Nos. 1,587,266, 1,758,773, 2,074,951, 2,953,354, 3,367,430, 4,408,669, 4,440,244, 4,635,738, 5,040,621, 5,052,503, 5,165,494, 5,678,644 all herein incorporated by reference, and European Patent Application 0,058,061.

Modern bi-center drill bits are typically used in difficult drilling applications where the earth formations are badly fractured, where there is hole swelling, where the borehole has a tendency to become spiraled, or in other situations where an oversize hole is desirable.

In these difficult drilling applications, the top portion of the well bore is often stabilized by setting and cementing casing. The cement, shoe, float, and related cementing hardware are then typically drilled out of the casing by a drill bit that is run into the casing for this purpose. Once the cement and related hardware are drilled out, the drill-out bit is tripped out of the hole and a bi-center drill bit is run back in. Drilling then proceeds with the bi-center drill bit, which drills a hole into the formation below the casing with a diameter that is greater than the inside diameter of the casing.

To reduce drilling expenses, attempts have been made to drill the cement and related hardware out of the casing, and then drill the formation below the casing with a single bi-center drill bit. These attempts often resulted in heavy damage to both the casing and the bi-center drill bit.

The casing tends to be damaged by the gauge cutting elements mounted on the bi-center drill bit because inside the casing the pilot section of the bit is forced to orbit about its center, causing the gauge cutters to engage the casing. The forced orbiting action of the pilot section also causes damage to the cutters on the leading face of the bi-center drill bit.

The degree of damage to both the casing and the bit is further increased when a directional drilling bottom hole assembly is attached to the drill string just above the bit. It is often desirable to directionally drill the borehole beneath the casing with directional drilling systems utilizing bent subs. When the bi-center drill bit drills the cement and related hardware out of the casing with a bent sub directional system, the side forces caused by the forced orbiting action of the bi-center drill bit are additive with the side forces caused by rotating with a bent sub. The resulting complex, and excessive forces have caused failures in bi-center drill bits in as few as three feet of drilling. The same problems occur with related directional drilling systems that force the bi-center drill bits along paths other than their centerlines.

BRIEF SUMMARY OF THE INVENTION

The present invention is a bi-center drill bit designed to drill out the cement and other material in the casing and then proceed to drill out the full gauge drilling diameter borehole with a diameter greater than the inside of the casing. The bi-center drill bit is configured with non-drilling bearing elements that contact with the casing when the bit is drilling the cement without allowing the gauge cutting elements of the bi-center drill bit to contact the casing. The bi-center drill bit also has a cutting element configuration which prevents reverse scraping of the cutting elements when drilling both the cement and the formation.

Disclosed is a bi-center drill bit with a bit body with a first end adapted to be detachably secured to a drill string, a pilot section on a second, opposite end of the bit body and a reamer section intermediate the first and second ends. There are a plurality of cutting elements on the pilot section, a first center of rotation of the pilot section, and a first cutting face surface on the pilot section generated by the plurality of cutting elements as they are rotated about the first center of rotation of the pilot section. There is a second center of rotation of the pilot section spaced apart from the first center of rotation by a distance D with a second cutting face surface on the pilot section generated by the plurality of cutting elements as they are rotated about the second center of rotation of the pilot section. There is also a first region of the pilot section centered about the first center of rotation having a radius D, a second region of the pilot section centered about the second center of rotation having a radius D and a third region of the pilot section formed by the intersection of the first region and the second region. There are no cutting elements lying within the third region of the pilot section that contact both the first cutting face surface and the second cutting face surface.

Also disclosed is a bi-center drill bit with a bit body, the bit body having a longitudinal axis, a first end adapted to be detachably secured to a drill string, a pilot section on a second, opposite end of the bit body and an eccentric reamer section intermediate the first and second ends. There are a plurality of cutting elements on the pilot section, a first center of rotation of the pilot section about the longitudinal axis, and a radius of rotation R1 of the drill bit about the first center of rotation. There is a second center of rotation of the pilot section spaced apart from the first center of rotation by a distance D and a radius of rotation R2 of the drill bit about the second center of rotation. The radius of rotation R1 is less than the sum of the radius of rotation R2 and D.

Also disclosed is a bi-center drill bit with a bit body, the bit body having a longitudinal axis, a first end adapted to be detachably secured to a drill string, a pilot section on a second, opposite end of the bit body and an eccentric reamer section intermediate the first and second ends. There are a plurality of cutting elements on the pilot section, a first center of rotation of the pilot section about the longitudinal axis, and a radius of rotation R1 of the drill bit about the first center of rotation. There is a second center of rotation of the pilot section spaced apart from the first center of rotation by a distance D, and a radius of rotation R2 of the drill bit about the second center of rotation. The radius of rotation R1 is less than the sum of the radius of rotation R2 and D and a plurality of non-cutting bearing elements are mounted upon the bit body at radius R2.

Also disclosed is a bi-center drill bit with a bit body, the bit body having a longitudinal axis, a first end adapted to be detachably secured to a drill string, a pilot section on a second, opposite end of the bit body and an eccentric reamer section intermediate the first and second ends. There are a plurality of cutting elements on the pilot section, a first center of rotation of the pilot section about the longitudinal axis, and a radius of rotation R1 of the drill bit about the first center of rotation. There is a second center of rotation of the pilot section spaced apart from the first center of rotation by a distance D and a radius of rotation R2 of the drill bit about the second center of rotation. The radius of rotation R1 is less than the sum of the radius of rotation R2 and D and a plurality of gauge cutting elements are mounted upon the bit body at radius R1.

Also disclosed is a bi-center drill bit with a bit body, the bit body having a longitudinal axis, a first end adapted to be detachably secured to a drill string, a pilot section on a second, opposite end of the bit body and an eccentric reamer section intermediate the first and second ends. There are a plurality of cutting elements on the pilot section, a first center of rotation of the pilot section about the longitudinal axis, and a radius of rotation R1 of the drill bit about the first center of rotation. There is a second center of rotation of the pilot section spaced apart from the first center of rotation by a distance D and a radius of rotation R2 of the drill bit about the second center of rotation. The radius of rotation R1 is less than the sum of the radius of rotation R2 and D and a plurality of non-cutting bearing elements are mounted upon the bit body at radius R2 and a plurality of gauge cutting elements are mounted upon the bit body at radius R1.

Also disclosed is a bi-center drill bit with a bit body with a first end adapted to be detachably secured to a drill string, a pilot section on a second, opposite end of the bit body and a reamer section intermediate the first and second ends. There are a plurality of cutting elements on the pilot section, a first center of rotation of the pilot section and a second center of rotation of the pilot section spaced apart from the first center of rotation by a distance D. There is a first region of the pilot section centered about the first center of rotation having a radius D, a second region of the pilot section centered about the second center of rotation having a radius D, and a third region of the pilot section formed by the intersection of the first region and the second region. The third region of the pilot section is devoid of cutting elements.

Also disclosed is a bi-center drill bit with a bit body, the bit body having a longitudinal axis, a first end adapted to be detachably secured to a bent sub directional drill tool, a pilot section on a second, opposite end of the bit body and a reamer section intermediate the first and second ends. The outer portion of the pilot section is an uninterrupted circular section.

DETAILED DESCRIPTION OF THE INVENTION AND THE PREFERRED EMBODIMENT

Figure 1:
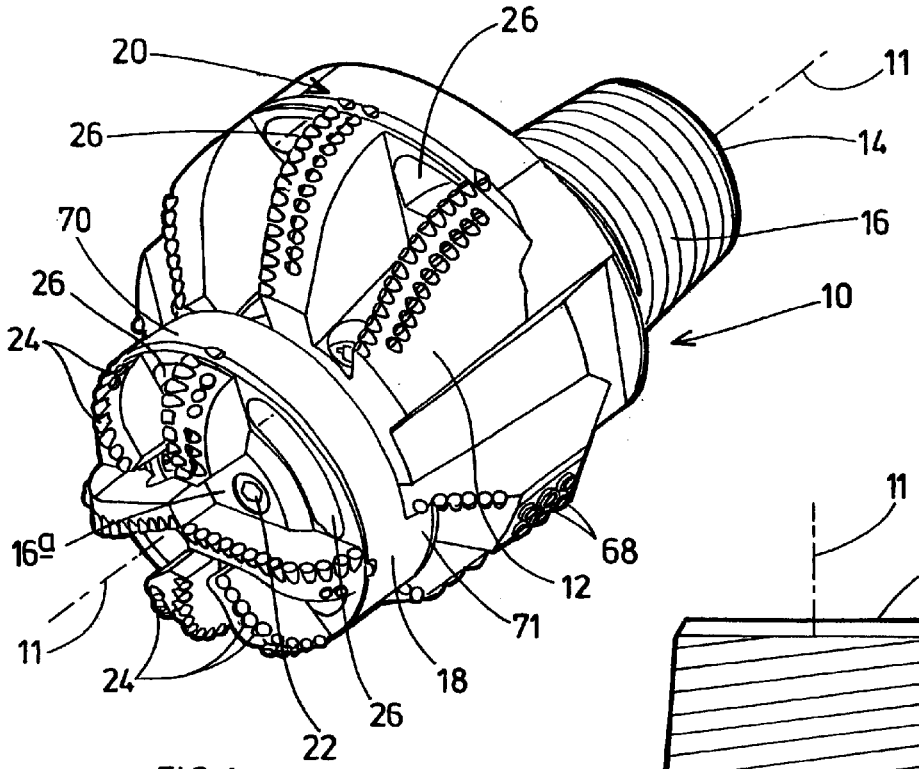
FIG. 1 is a perspective view of a bi-center drill bit of the present invention.
Figure 2A:
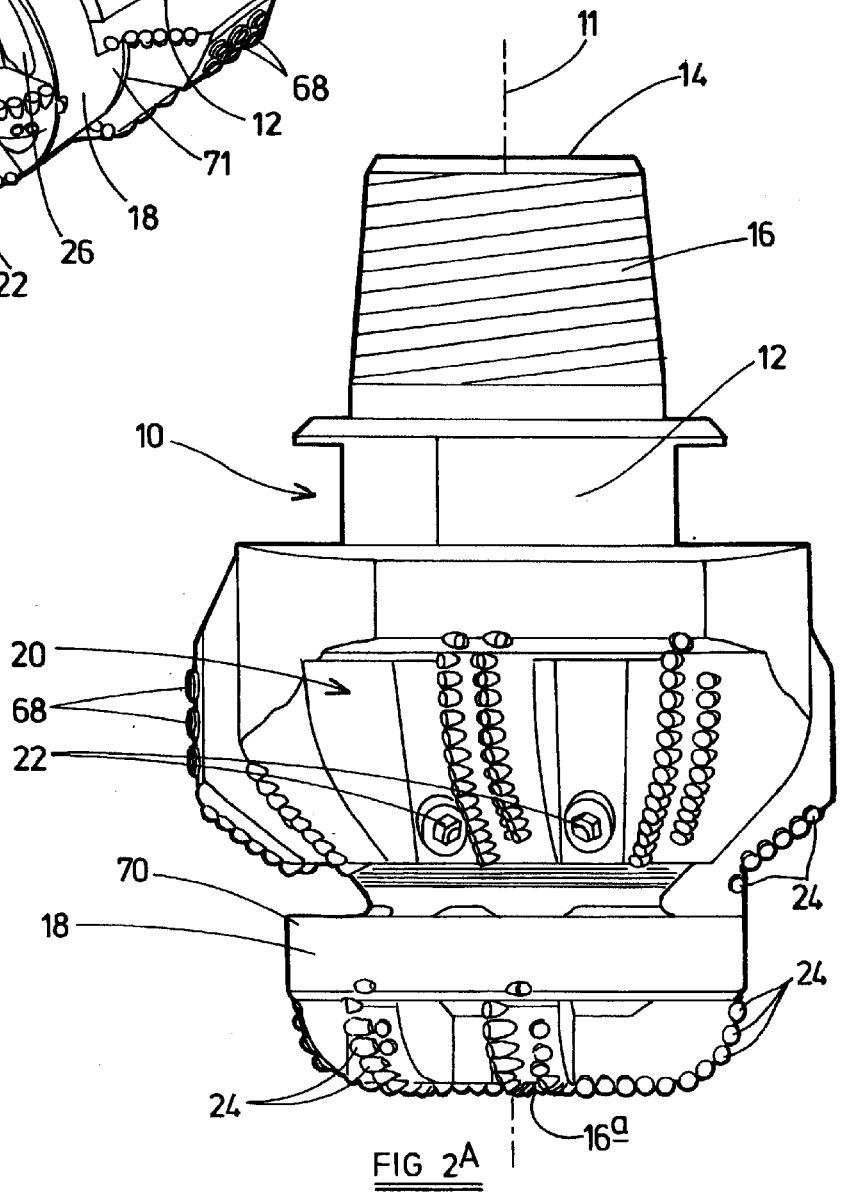
FIG. 2A is a side view of a bi-center drill bit of the present invention.

As shown in FIGS. 1 and 2A, the bi-center drill bit 10 of the present invention has a longitudinal axis 11, a bit body 12 with a first end 14 which is adapted to be secured to a drill string (not shown). Typically, threads 16 are used for attachment to the drill string, but other forms of attachment may also be utilized. At the second, opposite end 16 of the bit body 12 is the pilot section 18 of the bi-center drill bit 10. A reamer section, shown generally by numeral 20, is intermediate the first end 14 and the pilot section 18 of the bi-center drill bit 10.

During operation, the bit body 12 is rotated by an external means while the bi-center drill bit 10 is forced into the material being drilled. The rotation under load causes cutting elements 24 to penetrate into the drilled material and remove the material in a scraping and/or gouging action.

The bit body 12 has internal passaging (not shown) with allows pressurized drilling fluid to be supplied from the surface to a plurality of nozzle orifices 22. These nozzle orifices 22 discharge the drilling fluid to clean and cool the cutting elements 24 as they engage the material being drilled. The drilling fluid also transports the drilled material to the surface for disposal.

In one preferred embodiment the pilot section 18 has an uninterrupted circular section 70 with at least one fluid passage 26 provided for return flow of the drilling fluid. The uninterrupted circular section 70 will be described in greater detail later in the specification. There also may be other fluid passages 26 provided in the reamer section 20 of the bi-center drill bit 10.

Figure 2B:
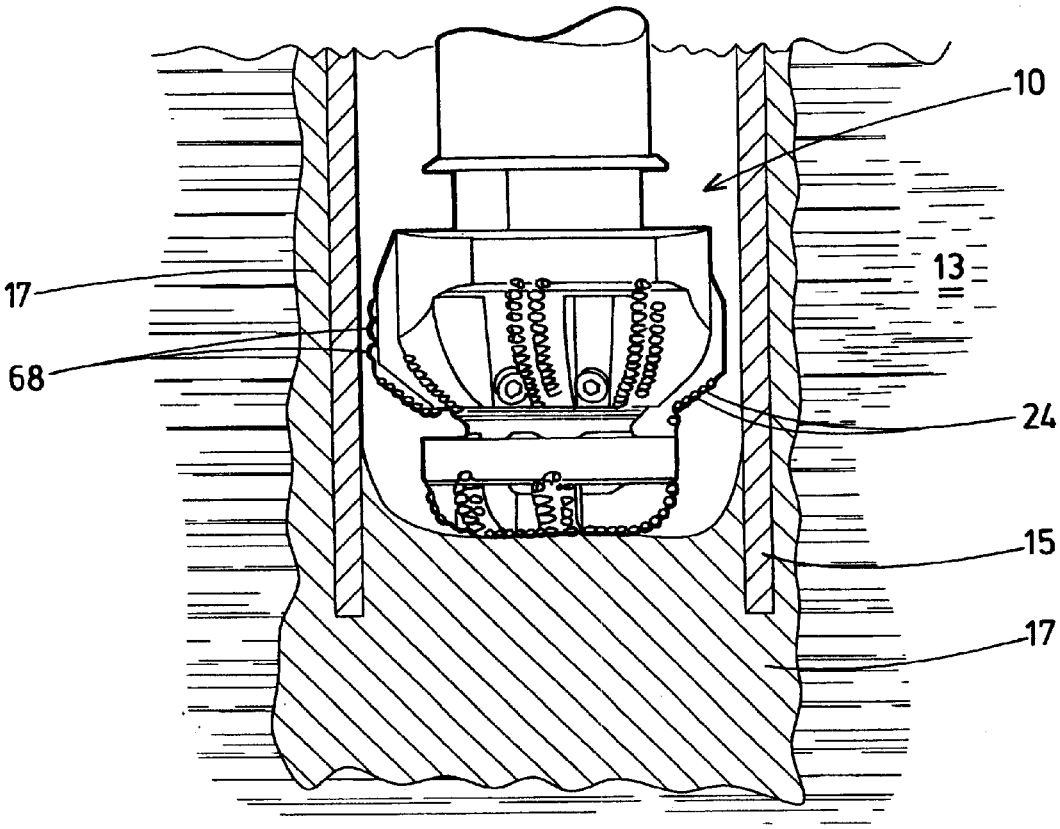
FIG. 2B is a side view of a bi-center drill bit of the present invention shown drilling the cement within the casing set in a borehole in the earth.
Figure 2C:
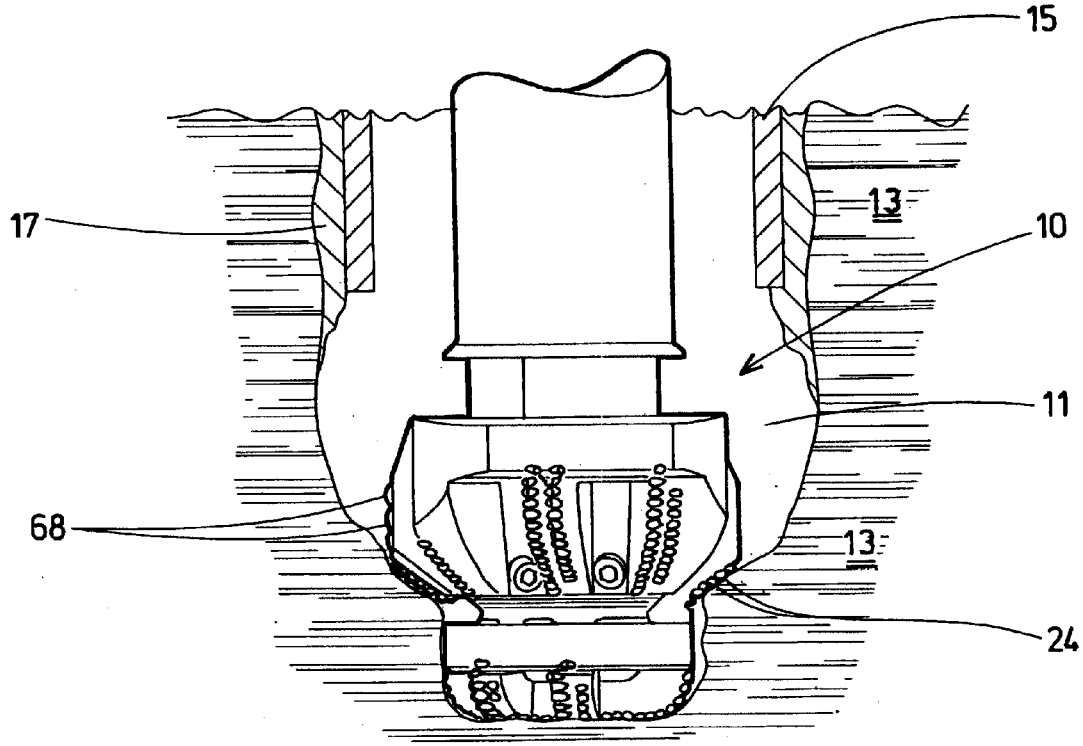
FIG. 2C is a side view of a bi-center drill bit of the present invention shown drilling a full gauge borehole in an earth formation below a smaller diameter casing.

Referring now to FIGS. 2B and 2C, shown are side views of a bi-center drill bit 10 of the present invention. One important characteristic of the bi-center drill bit 10 is its ability to drill a borehole 11 into the earth 13 with a gauge drilling diameter larger than the inside diameter of the casing 15, or pipe or other type of conductor the bit 10 must pass through. This characteristic is shown in FIG. 2C.

Another important characteristic of the of the bi-center drill bit 10 is its ability to drill out the cement 17 (and related hardware, not shown) inside the casing 15 as shown in FIG. 2B without causing damage to the casing 15 or the cutting elements 24.

Figure 3:
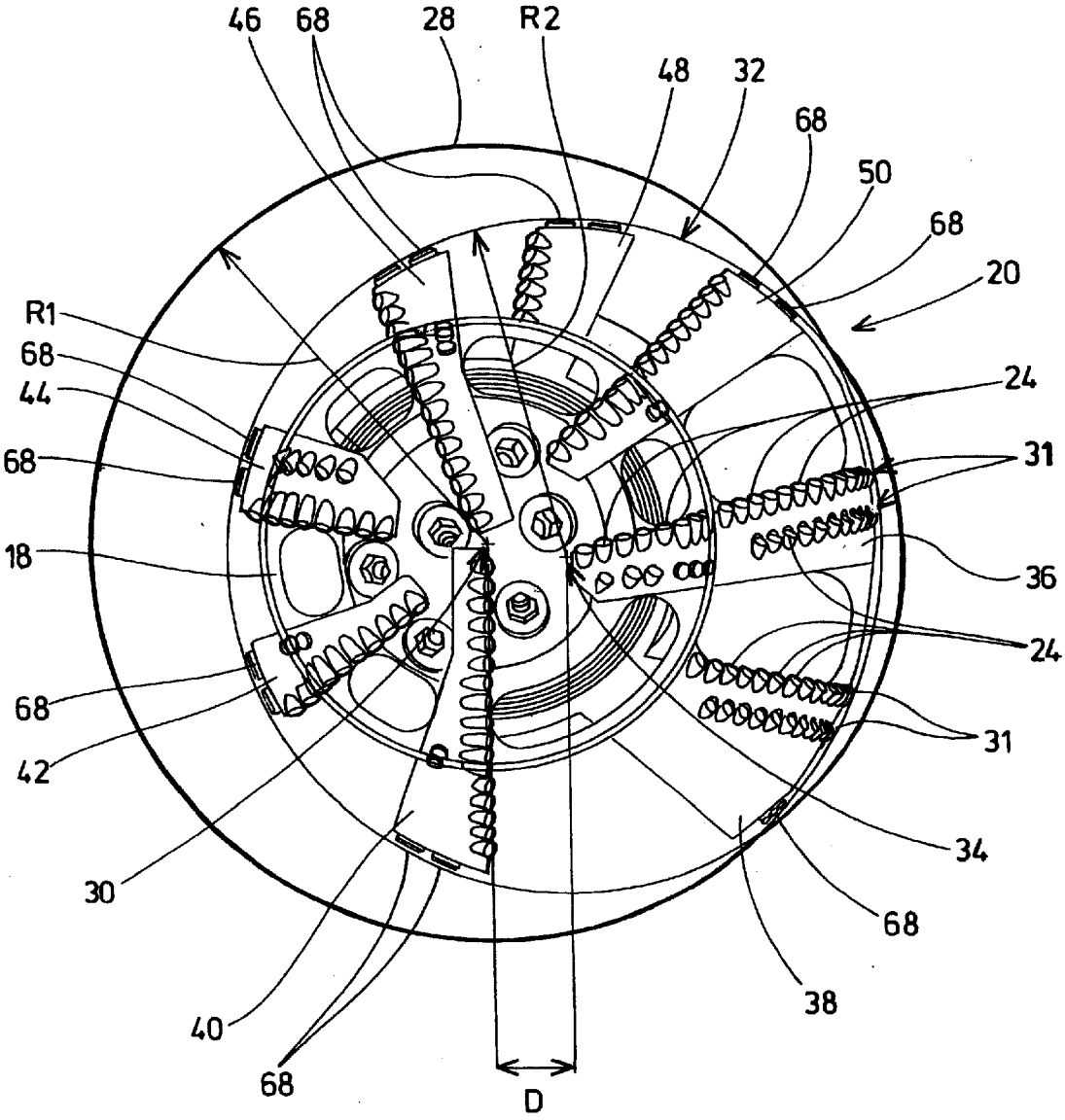
FIG. 3 is an end view of a bi-center drill bit of the present invention.

Referring now to FIG. 3, shown is an end view of a bi-center drill bit 10 of the present invention. The gauge drilling diameter, as indicated by the circle 28, is generated by radius R1 from a first center of rotation 30 of the pilot section 18. In this drilling mode, the uninterrupted circular section 70 of the pilot section will be concentric with the diameter 28. The cutting elements 24 on the portion of the reamer section 20 radially furthest from the first center of rotation 30 actually drills the gauge drilling diameter of the borehole 11, as indicated at numeral 31. The reamer section 20 is formed eccentrically of the pilot section 18, so only a portion of the wall of the borehole 11 is in contact with the cutting elements 24 which cut the final gauge of the borehole at any given time during operation.

The bi-center drill bit 10 also has a pass through diameter, as indicated by the circle 32, generated by radius R2 from a second center of rotation 34 of the pilot section 18. The shortest linear distance between the centers of rotation 30, 34 is indicated as D. The second center of rotation 34 is on the centerline of the smallest cylinder that can be fitted about the bi-center drill bit 10. To be effective, the pass through diameter as indicated by circle 32 must be smaller than the inside diameter of the casing 15 the bi-center drill bit 10 must pass through.

For optimal life, the cutting elements 24 must be oriented on the pilot section 18 in a known manner with respect to the direction of scraping through the material being drilled. This is no problem for bi-center drill bits that do not drill the cement and related hardware out of the casing. However, when a bi-center drill bit is used to drill cement and related hardware in the casing, some of the cutting elements 24 may be subjected to reverse scraping while rotating about the second center of rotation 34. Reverse scraping often causes rapid degradation of the cutting elements 24, and must be avoided.

For the embodiment of the invention shown in FIGS. 1–5, 6A, 6B, 6C, and 9 the cutting elements 24 are polycrystalline diamond compact cutters or PDC. A PDC is typically comprised of a facing table of diamond or other superhard substance bonded to a less hard substrate material, typically formed of but not limited to, tungsten carbide. The PDC is then often attached by a method known as long substrate bonding to a post or cylinder for insertion into the bit body 12. This PDC type of cutting element 24 is particularly sensitive to reverse scraping because loading from reverse scraping can easily destroy both the diamond table bonding and the long substrate bonding.

Figure 4:
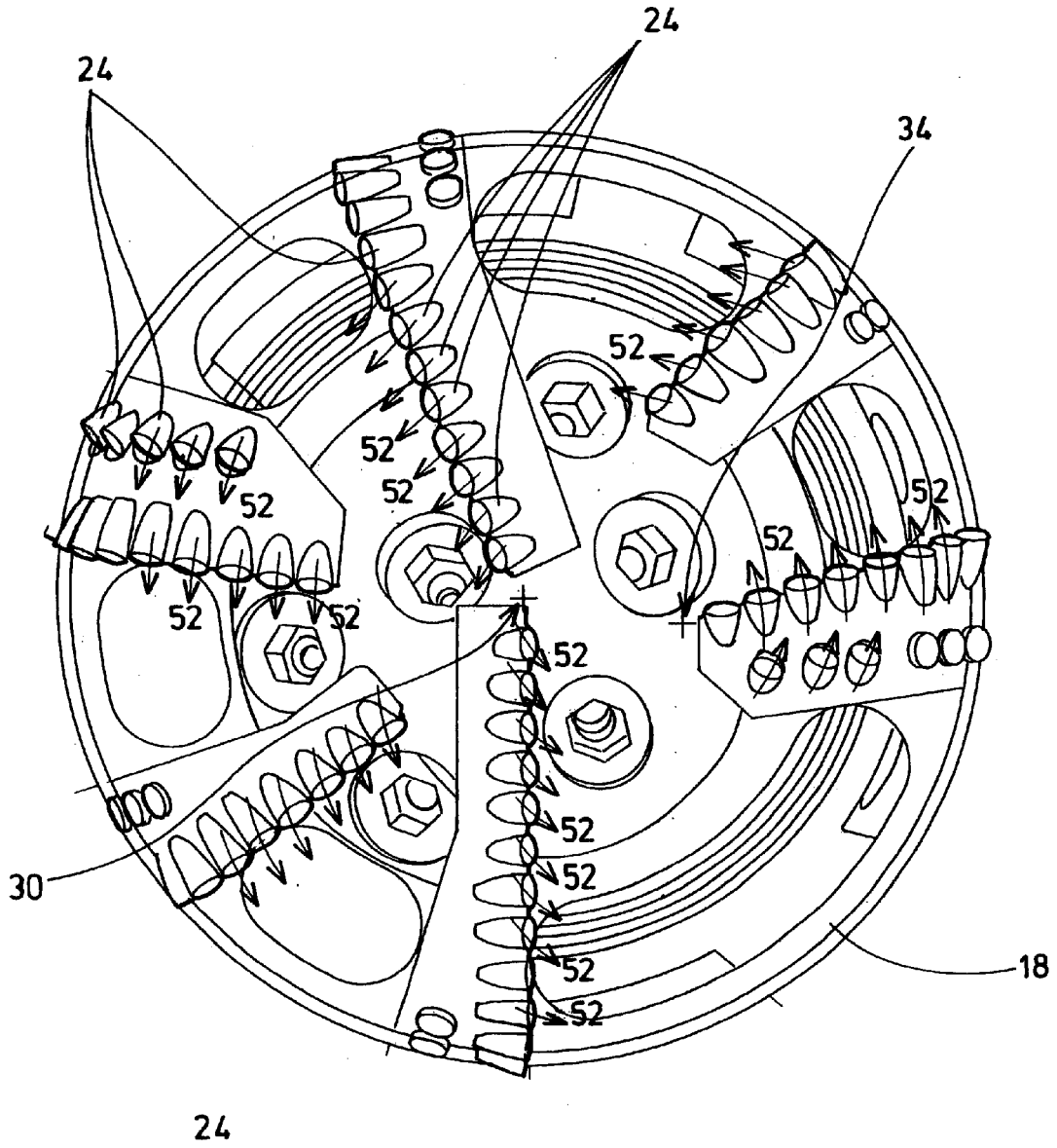
FIG. 4 is an enlarged view of a portion of the bi-center drill bit of FIG. 3.
Figure 5:
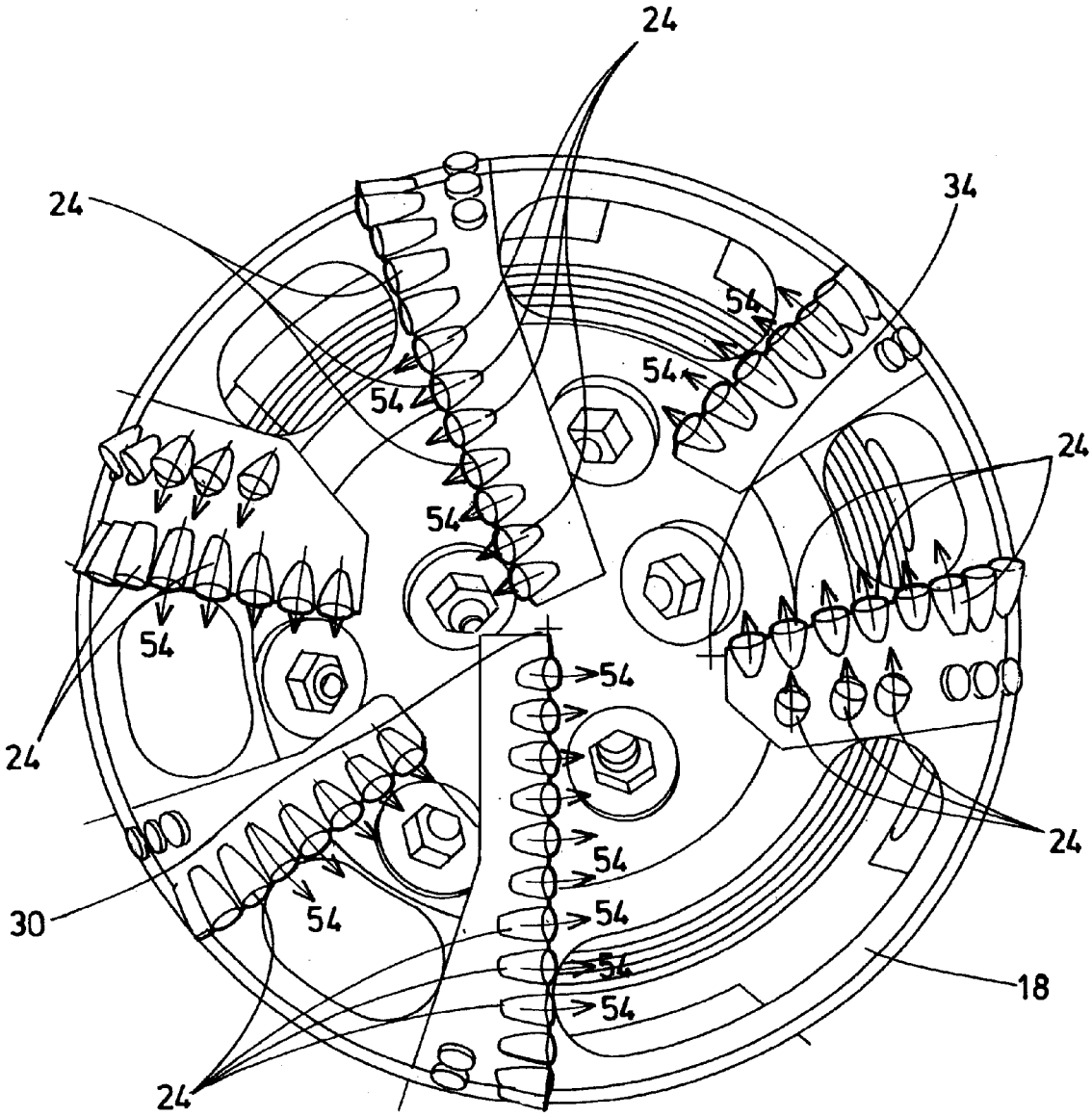
FIG. 5 is another enlarged view of a portion of the bi-center drill bit of FIG. 3.

Shown in FIGS. 4 and 5 are the paths of cutting elements 24 on the pilot section 18 of the bi-center drill bit 10 as they are rotated about each center of rotation 30, 34. In FIG. 4 the cutting elements 24 on the pilot section 18 are rotated about the second center of rotation 34. The bi-center drill bit 10 rotates about the second center of rotation 34 when it is drilling the material inside the casing 15 as shown in FIG. 2B. Directional arrows 52 are displayed for many of the cutting elements 24. The directional arrows 52 show the paths of the cutting elements 24 relative to the material being drilled as the bi-center drill bit 10 is rotated about the second center of rotation 34. As is apparent, none of the cutting elements 24 are subject to reverse scraping.

In FIG. 5 the cutting elements 24 are rotated about the first center of rotation 30. The pilot section 18 on bi-center drill bit 10 rotates about the first center of rotation 30 when the bit is drilling a borehole 11 beneath the casing 15 as shown in FIG. 2C. Directional arrows 54 are displayed for many of the cutting elements 24. The directional arrows 54 show the paths of the cutting elements 24 relative to the material being drilled as the pilot section 18 on bi-center drill bit 10 is rotated about the first center of rotation 30. As is again apparent, none of the cutting elements 24 are subject to reverse scraping.

Figures 6A, 6B, 6C:
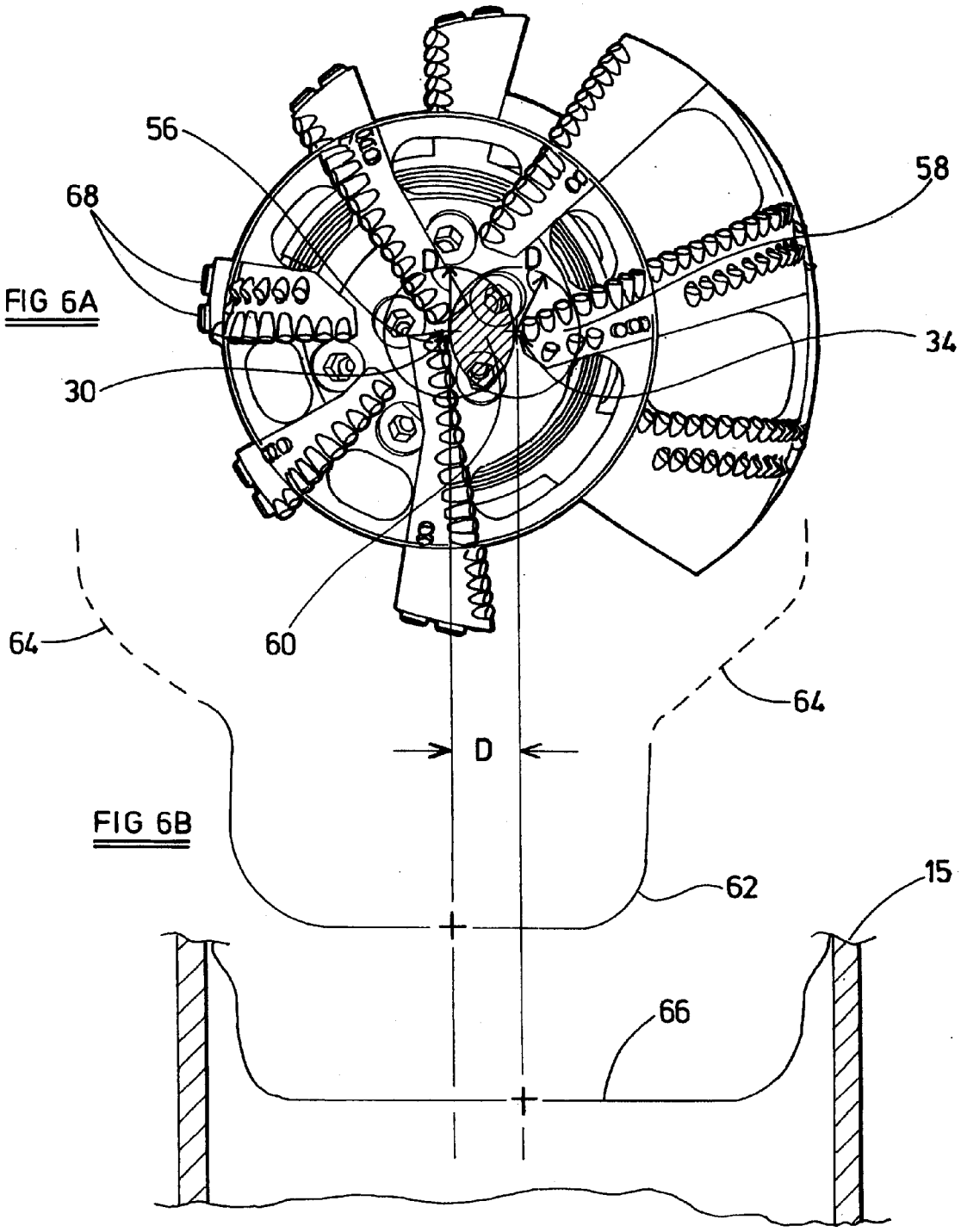
FIG. 6A is an end view of a bi-center drill bit of the present invention showing certain relationships.
FIG. 6B is view of the first cutting surface generated by the cutters of the bi-center drill bit of FIG. 6A.
FIG. 6C is view of the second cutting surface generated by the cutter of the bi-center drill bit of FIG. 6A.

FIGS. 6A, 6B, and 6C represent how the arrangement of the cutting elements 24 can be characterized in order to prevent reverse scraping. As stated earlier, the distance D is the shortest linear distance between center of rotation 30 and center of rotation 34. A first region 56 of the pilot section 18 centered about the first center of rotation 30 has a radius D. A second region 58 of the pilot section 18 is centered about the second center of rotation 34, and also has a radius D. A third region 60 of the pilot section 18 is formed by the intersection of the first region 56 and the second region 58. This iris shaped third region 60 is the critical area where reverse cutter scraping is possible.

A first cutting face surface on the pilot section is illustrated in FIG. 6B with numeral 62, and a second cutting face surface on the pilot section is illustrated in FIG. 6C with numeral 66. A cutting face surface 62, 66 is the hypothetical surface generated by the tips of the cutting elements 24 as they are rotated about one of the centers of rotation 30, 34.

By way of example, the first cutting face surface 62 as generated has the same shape as the surface of the bottom of the hole drilled by the pilot section 18 of the bi-center drill bit 10. However, because the cutting elements 24 penetrate into the formation 13 a small distance to create the first cutting face surface 62, the surface 62 will be positioned on the pilot section intermediate the tips of the cutting elements 24 and the body of the pilot section 18. The cutting face surface of the reamer section 20 is shown as numeral 64.

In one embodiment of the bi-center drill bit 18 of the present invention the third region 60 on the pilot section 18 is devoid of cutting elements 24, as shown in FIGS. 1–6C and 9. This assures that none of the cutting elements 24 will experience reverse cutter scraping.

Figure 7:
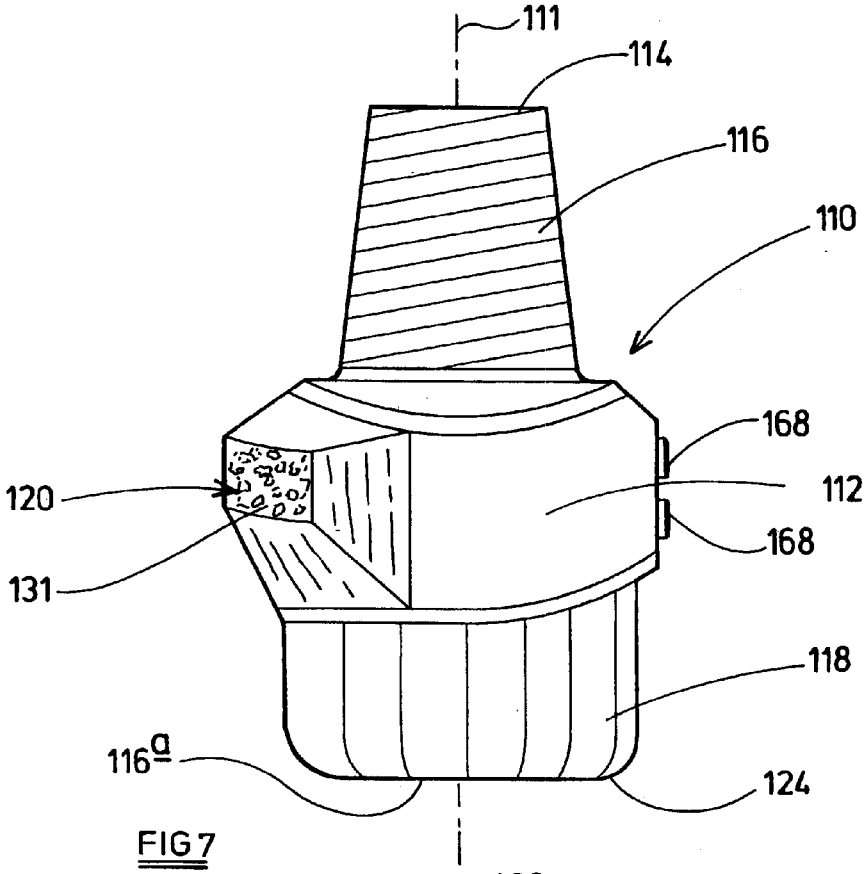
FIG. 7 is a side view of an alternate preferred embodiment of the bi-center drill bit of the present invention.
Figure 8:
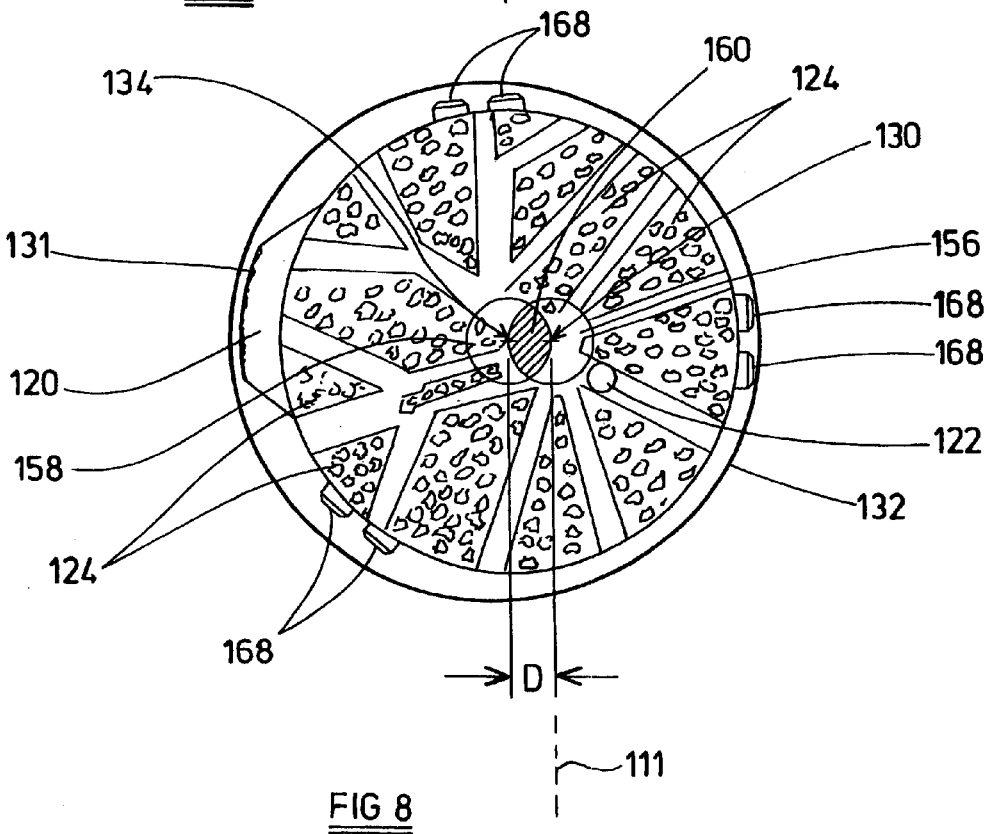
FIG. 8 is an end view of the alternate preferred embodiment of the bi-center drill bit shown in FIG. 7.

Shown in FIGS. 7 and 8 is an alternate design bi-center drill bit 110. The bi-center drill bit 110 illustrated is an infiltrated type bi-center drill bit. The bi-center drill bit 110 has a longitudinal axis 111, a bit body 112 with a first end 114 which is adapted to be secured to a drill string (not shown). Typically, threads 116 are used for attachment to the drill string, but other forms of attachment may also be utilized. At the second, opposite end 116 of the bit body 112 is the pilot section 118 of the bi-center drill bit 110. A reamer section shown generally by numeral 120 is intermediate the first end 114 and the pilot section 118 of the bi-center drill bit 110.

Cutting elements 124 in an infiltrated bit are typically natural or synthetic diamond or other superhard particles that are arranged upon the surface. In one type of infiltrated bit, the cutting elements 124 are fairly large natural diamonds (greater about than 0.5 carat) partially exposed at the surface. In another type of infiltrated bit, the cutting elements 124 are much smaller diamonds or diamond-like particles impregnated within the matrix to a significant depth.

During operation, the bit body 112 is rotated by some external means while the bi-center drill bit 110 is forced into the material being drilled. The rotation under load causes cutting elements 124 to penetrate into the drilled material and remove the material in a scraping and/or gouging action.

The bit body 112 has internal passaging (not shown) which allows pressurized drilling fluid to be supplied from the surface to a plurality of orifices 122. These orifices 122 discharge the drilling fluid to clean and cool the cutting elements 124 as they engage the material being drilled. The drilling fluid also transports the drilled material to the surface for disposal. The other elements of the bi-center drill bit 110 similar to the bi-center drill bit 10 are indicated by numerals increased by 100.

In the bi-center drill bit 110 shown in FIGS. 7 and 8, it may be desirable to place some of the cutting elements 124 in the third region 160 of the pilot section. As it is still desirable not to subject cutting elements 124 to reverse scraping, they may be oriented such that they contact one of the cutting face surfaces 62, 66 when operating in that drilling mode, and yet be of a different height with respect to the body 112 such that they are intermediate the other cutting face surface and the body of the pilot section 118 when operating in the other drilling mode. In this arrangement, none of the cutting elements 24, 124 lying within the third region 60, 160 contact both the first cutting face surface 62 and the second cutting face surface 66.

In another aspect of the preferred embodiment of the bi-center drill bit 10, 110 of the present invention, a relationship is established among R1, R2, and D which allows a design of the bi-center drill bit 10, 110 to drill the cement and related hardware out of the casing without the risk of damaging the casing 15.

When the radius of rotation R1 about the first center of rotation is less than the sum of the radius of rotation R2 about the second center of rotation and D, the gauge cutting elements 31 cannot contact the casing 15 as the bi-center drill bit 10, 110 is operated in or passed through the casing 15. This is shown as a gap between circle 28 and circle 32 at the location of gauge cutting elements 31, 131.

A bi-center drill bit made with the relationship of $R1<R2+D$ will assure that the casing 15 will not be damaged by the gauge cutting elements 31, 131.

The bi-center drill bit 10 of FIGS. 1–3 has a plurality of blades 36, 38, 40, 42, 44, 46, 48, 50. A plurality of non-cutting bearing elements 68 are mounted upon the blades 38, 40, 42, 44, 46, 48, 50 to set the pass through diameter, as indicated by the circle 32.

These non-cutting bearing elements 68 are spaced around the arc of the circle 32 at a maximum spacing angle less than 180 degrees. When the non-cutting bearing elements 68 are placed in this manner the casing 15 is further protected from wear by the blades 38, 40, 42, 44, 46, 48, 50.

Referring now to FIGS. 7 and 8, in a similar manner, non-cutting bearing elements 168 are spaced on the infiltrated bi-center drill bit 110 to prevent the gauge 131 cutting elements 124 from damaging the casing 15 and/or cause damage to the gauge cutting elements 131.

There are many suitable forms of non-cutting bearing elements 68, 168. For example, the bearing elements 68, 168 may simply be the ends of one or more of the blades 38, 40, 42, 44, 46, 48, 50. It is possible to join one or more of these blades with a continuous ring or other structure connecting the blades to form an elongated bearing with greater contact. It is also possible to make the ring or structure of a smaller radius than R2, and place a plurality of individual non-cutting bearing elements 68, 168 along the ring or structure with enough protrusion to form the radius R2, as shown.

Non-cutting bearing elements 68, 168 may be in the form of flush type or protruding PDC, tungsten carbide, or other hard material inserts. The non-cutting bearing elements 68, 168 may also be in the form of a flame spray coating containing one or more hard, wear resistant materials such as carbides of tungsten, titanium, iron, chromium, or the like. It is also possible to apply a diamond-like-carbon material to act as a non-cutting bearing element 68, 168.

In addition to placing the non-cutting bearing elements 68, 168 along the blades 38, 40, 42, 44, 46, 48, 50, they may also optionally be placed in the uninterrupted circular section 70 of the pilot section 18. In the uninterrupted circular section 70, the non-cutting bearing elements 68 help reduce the wear on the uninterrupted circular section 70 caused as the reaction force of the stabilizer section 20 pushes the uninterrupted circular section 70 into the formation 13.

Because the non-cutting bearing elements 68 are placed along the radius R2, it is possible to put both non-cutting bearing elements 68 and gauge cutting elements 31 on the same blade 38. Blade 38 is shaped such that the non-cutting bearing elements 68 are on a surface that has been relieved away from radius R1 to permit mounting of the non-cutting bearing elements 68.

Preferably, this relieved surface will be concentric with radius R2. The result is that blade 38 will have surfaces with two radii, one surface concentric with radius R2 and a second surface concentric with radius R1.

Although this is shown on only one blade 38 in FIG. 3, it is possible to have the non-cutting bearing elements 68 and the gauge cutting elements 31 on a second blade if the blade is positioned adjacent to one of the intersections of R1 and R2 as indicated by numeral 39. Placing the non-cutting bearing elements 68 on a blade in this manner provides the maximum stability for the bi-center drill bit as it drills the cement 17 from the casing 15.

In the bi-center drill bit of FIGS. 1–7, the pilot section 18 may have an uninterrupted circular section 70. The uninterrupted circular section 70 acts to stabilize the pilot section 70 when the bi-center drill bit 10 is drilling the gauge drilling diameter in the formation 13. As previously described, the uninterrupted circular section 70 also acts as a bearing against the formation 13 to resist the side forces generated by the reamer section 20 as it drills the gauge diameter of the borehole 11. An additional bearing section 71 (shown in FIG. 1) may be provided on the uninterrupted circular section 70. This additional bearing section 71 adds additional bearing surface area to further reduce the unit loading and minimize wear of the side of the uninterrupted circular section 70 opposite from the reamer section 20.

Figure 9:
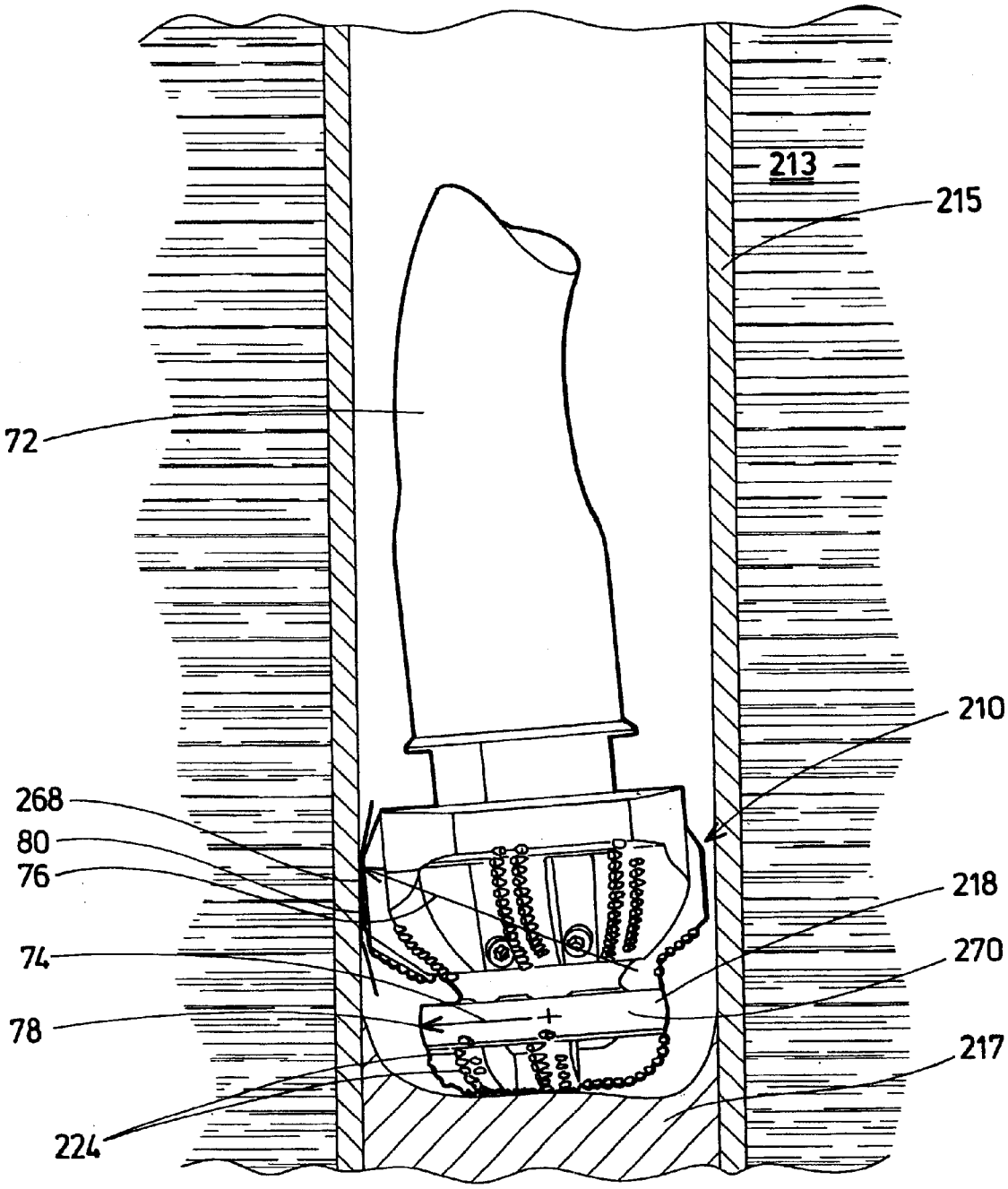
FIG. 9 is another alternate preferred embodiment of a bi-center drill bit of the present invention for use with a bent sub directional drill tool.

Shown in FIG. 9 is a bi-center drill bit 210 configured in a very similar manner to the bi-center drill bit 10, 110 of FIGS. 1–8. For brevity of description, elements of the bi-center drill bit 210 with characteristics similar to the bi-center drill bit 10 are indicated with numerals increased by 200.

In FIG. 9, the uninterrupted circular section 270 on the pilot section 218 also provides a secondary bearing surface when the bi-center drill bit is driven by a bent sub type directional drill tool 72. In addition, the uninterrupted circular section 270 is provided with a curved end 78, generated by radius 74, and a curved profile 80 for the non-cutting bearing elements 268, generated by radius 76. The curved end 78 and curved profile 80 act to prevent the corners of the uninterrupted circular section 270, and the non-cutting bearing elements 268 from damaging the casing 215.

Whereas the present invention has been described in particular relation to the drawings attached hereto, it should be understood that other and further modifications apart from those shown or suggested herein, may be made within the scope and spirit of the present invention.

What is claimed is:

1. A bi-center drill bit comprising a bit body, the bit body having a longitudinal axis, a first end adapted to be detachably: secured to a drill string, a pilot section on a second, opposite end of the bit body and an eccentric reamer section intermediate the first and second ends, and a plurality of cutting elements on the pilot section, a first center of rotation of the pilot section about the longitudinal axis, a radius of rotation R1 of the drill bit about the first center of rotation, a second center of rotation of the pilot section spaced apart from the first center of rotation by a distance D, a radius of rotation R2 of the drill bit about the second center of rotation, the radius of rotation R1 is less than the sum of the radius of rotation R2 and distance D, wherein a plurality of non-cutting bearing elements are mounted upon the bit body at radius R2.

2. The bi-center drill bit of claim 1 further comprising a first plurality of blades extending from the bit body and a second plurality of blades extending from the bit body whereby the first plurality of blades terminates with a plurality of gauge cutting elements extending to radius of rotation R1, and the second plurality of blades terminates in at least one of the non-cutting bearing elements.

3. The bi-center drill bit of claim 2 wherein the non-cutting bearing elements are in the form of a flush mounted, hard, wear resistant material.

4. The bi-center drill bit of claim 3 wherein the non-cutting bearing elements are in the form of a flame spray coating containing the carbides of elements selected from the group consisting of tungsten, titanium, iron, and chromium.

5. The bi-center drill bit of claim 4 wherein the coating is generally uniformly applied over a portion of the at least two blades.

6. The bi-center drill bit of claim 2 wherein the non-cutting bearing elements are in the form of a protruding insert made of a hard, wear resistant material.

7. The bi-center drill bit of claim 6 wherein the hard, wear resistant material is cemented tungsten carbide.

8. The bi-center drill bit of claim 7 wherein the hard, wear resistant material is a preform element with a facing table of diamond bonded to a less hard substrate material.

9. The bi-center drill bit of claim 2 wherein the gauge cutting elements are formed of a superhard material.

10. The bi-center drill bit of claim 9 wherein the superhard material is a preform element with a facing table of diamond bonded to a less hard substrate material.

11. The bi-center drill bit of claim 10 wherein the facing table of diamond comprises polycrystalline diamond.

12. The bi-center drill bit of claim 9 wherein the superhard material is natural diamond.

13. The bi-center drill bit of claim 1 wherein a maximum included angle about the second center of rotation between any two adjacent non-cutting bearing elements is less than 180 degrees.

14. A bi-center drill bit comprising a bit body, the bit body having a longitudinal axis, a first end adapted to be detachably secured to a drill string, a pilot section on a second, opposite end of the bit body and an eccentric reamer section intermediate the first and second ends, and a plurality of cutting elements on the pilot section, a first center of rotation of the pilot section about the longitudinal axis, a radius of rotation R1 of the drill bit about the first center of rotation, a second center of rotation of the pilot section spaced apart from the first center of rotation by a distance D, a radius of rotation R2 of the drill bit about the second center of rotation, the radius of rotation R1 is less than the sum of the radius of rotation R2 and distance D, wherein a plurality of gauge cutting cutter elements are mounted upon the bit body at radius R1.

15. The bi-center drill bit of claim 14 further comprising a first region of the pilot section centered about the first center of rotation having a radius of D, a second region of the pilot section centered about the second center of rotation having a radius of D, and a third region of the pilot section formed by the intersection of the first region and the second region, wherein the third region of the pilot section is devoid of cutting elements.

16. A bi-center drill bit comprising a bit body, the bit body having a longitudinal axis, a first end adapted to be detachably secured to a drill string, a pilot section on a second, opposite end of the bit body and an eccentric reamer section intermediate the first and second ends, and a plurality of cutting elements on the pilot section, a first center of rotation of the pilot section about the longitudinal axis, a radius of rotation R1 of the drill bit about the first center of rotation, a second center of rotation of the pilot section spaced apart from the first center of rotation by a distance D, a radius of rotation R2 of the drill bit about the second center of rotation, the radius of rotation R1 is less than the sum of the radius of rotation R2 and distance D, wherein a plurality of non-cutting bearing elements are mounted upon the bit body at radius R2 and a plurality of gauge cutting cutter elements are mounted upon the bit body at radius R1.

17. The bi-center drill bit of claim 16 further comprising a first region of the pilot section centered about the first center of rotation having a radius of D, a second region of the pilot section centered about the second center of rotation having a radius of D, and a third region of the pilot section is formed by the intersection of the first region and the second region, wherein the third region of the pilot section is devoid of cutting elements.

18. The bi-center drill bit of claim 17 further comprising a first plurality of blades extending from the bit body and a second plurality of blades extending from the bit body, whereby the first plurality of blades terminates in the plurality of gauge cutting elements and the second plurality of blades terminates in at least one of the non-cutting bearing elements.

19. The bi-center drill bit of claim 18 wherein a maximum included angle about the second center of rotation between any two adjacent non-cutting bearing elements is less than 180 degrees.

20. The bi-center drill bit of claim 18 wherein the non-cutting bearing elements are in the form of a flush mounted, hard, wear resistant material.

21. The bi-center drill bit of claim 20 wherein the non-cutting bearing elements are in the form of a flame spray coating containing the carbides of elements selected from the group consisting of tungsten, titanium, iron, and chromium.

22. The bi-center drill bit of claim 21 wherein the coating is generally uniformly applied over a portion of the at least two blades.

23. The bi-center drill bit of claim 18 wherein the non-cutting bearing elements are in the form of a protruding insert made of a hard, wear resistant material.

24. The bi-center drill bit of claim 23 wherein the hard, wear resistant material is cemented tungsten carbide.

25. The bi-center drill bit of claim 23 wherein the hard, wear resistant material is a preform element with a facing table of diamond bonded to a less hard substrate material.

26. The bi-center drill bit of claim 18 wherein the gauge cutting elements are formed of a superhard material.

27. The bi-center drill bit of claim 26 wherein the superhard material is a preform element with a facing table of diamond bonded to a less hard substrate material.

28. The bi-center drill bit of claim 27 wherein the facing table of diamond comprises polycrystalline diamond.

29. The bi-center drill bit of claim 26 wherein the superhard material is natural diamond.

30. A bi-center drill bit comprising a bit body with a first end adapted to be detachably secured to a drill string, a pilot section on a second, opposite end of the bit body and a reamer section intermediate the first and second ends, a plurality of cutting elements on the pilot section, a first center of rotation of the pilot section, a second center of rotation of the pilot section spaced apart from the first center of rotation by a distance D, a first region of the pilot section centered about the first center of rotation having a radius of D, a second region of the pilot section centered about the second center of rotation having a radius of D, and a third region of the pilot section formed by the intersection of the first region and the second region, wherein the third region of the pilot section is devoid of cutting elements.

31. The bi-center drill bit of claim 30 wherein the cutting elements of the pilot section are arranged upon a plurality of blades formed on the bit body.

32. The bi-center drill bit of claim 31 wherein the cutting elements of the pilot section are formed of a superhard material.

33. The bi-center drill bit of claim 32 wherein the superhard material is a preform element with a facing table of diamond bonded to a less hard substrate material.

34. The bi-center drill bit of claim 33 wherein the facing table of diamond comprises polycrystalline diamond.

35. The bi-center drill bit of claim 32 wherein the superhard material is natural diamond.

36. The bi-center drill bit of claim 30 further comprising at least two blades extending from the bit body and at least one non-cutting bearing element mounted on each blade, whereby the non-cutting bearing element extends to radius of rotation R2.

37. The bi-center drill bit of claim 36 wherein a maximum included angle about the second center of rotation between the non-cutting bearing elements on two adjacent blades is less than 180 degrees.

38. The bi-center drill bit of claim 36 wherein the non-cutting bearing elements are in the form of a flush mounted, hard, wear resistant material.

39. The bi-center drill bit of claim 38 wherein the non-cutting bearing elements are in the form of a flame spray coating containing the carbides of elements selected from the group consisting of tungsten, titanium, iron, and chromium.

40. The bi-center drill bit of claim 39 wherein the coating is generally uniformly applied over a portion of the at least two blades.

41. The bi-center drill bit of claim 36 wherein the non-cutting bearing elements are in the form of a protruding insert made of a hard, wear resistant material.

42. The bi-center drill bit of claim 41 wherein the hard, wear resistant material is cemented tungsten carbide.

43. The bi-center drill bit of claim 42 wherein the hard, wear resistant material is a preform element with a facing table of diamond bonded to a less hard substrate material.

44. A bi-center drill bit comprising a bit body with a first end adapted to be detachably secured to a drill string, a pilot section on a second, opposite end of the bit body and a reamer section intermediate the first and second ends, a plurality of cutting elements on the pilot section, a first center of rotation of the pilot section, a first cutting face surface on the pilot section generated by the plurality of cutting elements as they are rotated about the first center of rotation of the pilot section, a second center of rotation of the pilot section spaced apart from the first center of rotation by a distance D, a second cutting face surface on the pilot section generated by the plurality of cutting elements as they are rotated about the second center of rotation of the pilot section, a first region of the pilot section centered about the first center of rotation having a radius of D, a second region of the pilot section centered about the second center of rotation having a radius of D, and a third region of the pilot section formed by the intersection of the first region and the second region, wherein no cutting elements lying within the third region of the pilot section contact both the first cutting face surface and the second cutting face surface.

45. The bi-center drill bit of claim 44 wherein the cutting elements are arranged upon a plurality of blades formed on the bit body.

46. The bi-center drill bit of claim 44 wherein the cutting elements are formed of a superhard material.

47. The bi-center drill bit of claim 46 wherein the superhard material is a preform element with a facing table of diamond bonded to a less hard substrate material.

48. The bi-center drill bit of claim 47 wherein the table of diamond comprises polycrystalline diamond.

49. The bi-center drill bit of claim 46 wherein the superhard material is natural diamond.

50. The bi-center drill bit of claim 44 further comprising a radius of rotation R1 of the drill bit about the first center of rotation, and a radius of rotation R2 of the drill bit about the second center of rotation, wherein a plurality of non-cutting bearing elements are mounted upon the bit body at radius R2 and a plurality of gauge cutting cutter elements are mounted upon the bit body at radius R1.

51. The bi-center drill bit of claim 50 wherein a maximum included angle about the second center of rotation between any two adjacent non-cutting bearing elements is less than 180 degrees.

52. The bi-center drill bit of claim 50 wherein the non-cutting bearing elements are in the form of a flush mounted, hard, wear resistant material.

53. The bi-center drill bit of claim 52 wherein the non-cutting bearing elements are in the form of a flame spray coating containing the carbides of elements selected from the group consisting of tungsten, titanium, iron, and chromium.

54. The bi-center drill bit of claim 53 wherein the coating is generally uniformly applied over a portion of the at least two blades.

55. The bi-center drill bit of claim 50 wherein the non-cutting bearing elements are in the form of a protruding insert made of a hard, wear resistant material.

56. The bi-center drill bit of claim 55 wherein the hard, wear resistant material is cemented tungsten carbide.

57. The bi-center drill bit of claim 56 wherein the hard, wear resistant material is a preform element with a facing table of diamond bonded to a less hard substrate material.

58. The bi-center drill bit of claim 50 wherein the gauge cutting elements are formed of a superhard material.

59. The bi-center drill bit of claim 58 wherein the superhard material is a preform element with a facing table of diamond bonded to a less hard substrate material.

60. The bi-center drill bit of claim 59 wherein the facing table of diamond comprises polycrystalline diamond.

61. The bi-center drill bit of claim 50 wherein the superhard material is natural diamond.

62. A bi-center drill bit comprising a bit body, the bit body having a longitudinal axis, a first end adapted to be detachably secured to a drill string, a pilot section on a second, opposite end of the bit body and an eccentric reamer section intermediate the first and second ends, and a plurality of cutting elements, a first center of rotation of the pilot section about the longitudinal axis, a radius of rotation R1 of the drill bit about the first center of rotation, a second center of rotation of the pilot section spaced apart from the first center of rotation by a distance D, a radius of rotation R2 of the drill bit about the second center of rotation, the radius of rotation R1 is less than the sum of the radius of rotation R2 and distance D, the cutting elements are arranged upon a plurality of blades formed on the bit body wherein at least two of the blades extend from the bit body, the blades terminating with a gauge cutting element extending to radius of rotation R1 and at least one of the blades is located at the intersection of radius of rotation R1 and the radius of rotation R2 and has at least one non-cutting bearing element mounted thereon, the non-cutting bearing element extending to the radius of rotation R2.

63. The bi-center drill bit of claim 62 wherein the cutting elements are formed of a superhard material.

64. The bi-center drill bit of claim 63 wherein the superhard material is a preform element with a facing table of diamond bonded to a less hard substrate material.

65. The bi-center drill bit of claim 64 wherein the facing table of diamond comprises polycrystalline diamond.

66. The bi-center drill bit of claim 63 wherein the superhard material is natural diamond.

67. The bi-center drill bit of claim 62 wherein the non-cutting bearing element is in the form of a flush mounted, hard, wear resistant material.

68. The bi-center drill bit of claim 62 wherein the non-cutting bearing element is in the form of a flame spray coating containing the carbides of elements selected from the group consisting of tungsten, titanium, iron, and chromium.

69. The bi-center drill bit of claim 68 wherein the coating is generally uniformly applied over a portion of the at least two blades.

70. The bi-center drill bit of claim 62 wherein the non-cutting bearing element is in the form of a protruding insert made of a hard, wear resistant material.

71. The bi-center drill bit of claim 70 wherein the hard, wear resistant material is cemented tungsten carbide.

72. The bi-center drill bit of claim 71 wherein the hard, wear resistant material is a preform element with a facing table of diamond bonded to a less hard substrate material.

* * * * *